US007677143B1

(12) United States Patent
Piserchio

(10) Patent No.: US 7,677,143 B1
(45) Date of Patent: Mar. 16, 2010

(54) IMPACT TOOL AND METHOD

(76) Inventor: Louis Piserchio, 61 Sheridan Ave., West Orange, NJ (US) 07052

( * ) Notice: Subject to any disclaimer, the term of this patent is extended or adjusted under 35 U.S.C. 154(b) by 0 days.

(21) Appl. No.: 12/047,452

(22) Filed: Mar. 13, 2008

(51) Int. Cl.
*B25B 19/00* (2006.01)

(52) U.S. Cl. ..... 81/466; 173/93; 81/121.1

(58) Field of Classification Search ..... 81/463, 81/465–466, 124.7, 121.1, 124.2, 57.39; 29/275; 173/93, 93.5, 93.7
See application file for complete search history.

(56) References Cited

U.S. PATENT DOCUMENTS

| | | | | |
|---|---|---|---|---|
| 1,941,565 | A * | 1/1934 | Mandl | 81/121.1 |
| 2,279,118 | A * | 4/1942 | Fortune et al. | 81/176.15 |
| 3,366,187 | A | 1/1968 | Von Tersch | |
| 3,799,011 | A | 3/1974 | Davis, Jr. | |
| 3,861,250 | A | 1/1975 | Zugai | |
| 4,253,353 | A * | 3/1981 | Symbol | 81/124.7 |
| 4,708,209 | A | 11/1987 | Aspinwall | |
| 4,807,349 | A | 2/1989 | Blackmore | |
| 4,864,902 | A | 9/1989 | Doorley | |
| 5,904,076 | A | 5/1999 | Siwy | |
| 6,109,150 | A * | 8/2000 | Saccomanno, III | 81/478 |
| 6,370,993 | B1 | 4/2002 | Pitstick | |
| 6,668,686 | B1 | 12/2003 | Hsien | |
| 6,766,709 | B1 * | 7/2004 | West et al. | 74/425 |
| 7,044,035 | B2 | 5/2006 | Pregeant | |
| 7,089,833 | B2 | 8/2006 | Hamann et al. | |
| 2002/0092383 | A1 * | 7/2002 | Nezigane | 81/121.1 |
| 2003/0083747 | A1 * | 5/2003 | Winterbottom et al. | 623/17.11 |

OTHER PUBLICATIONS www.sears.com/shc/s/p_10153_12605_00952166000P?vertical=TOOL&pid=00952166000 Author unknown Publication date unknown.
buy1.snapon.com/catalog/item.asp?P65=&tool=hand&item_ID=118&group_ID=265&store=snapon-store&dir=catalog; and buy1.snapon.com/catalog/item.asp?P65=&tool=all&item_ID=1711&group_ID=223&store=snapon-store&dir=catalog Author unknown Publication date unknown.
www.abc.net.au/tv/newinventors/txt/s1754149.htm Author unknown Publication date unknown.
www.allo.com.au/auto-tools-handyman-tools/open-end-spanner-sets-metric.html Author unknown Publication Copyright 2006.

* cited by examiner

*Primary Examiner*—D. S Meislin
(74) *Attorney, Agent, or Firm*—Thomas L. Adams

(57) ABSTRACT

An impact tool will fit around a fastener such as a nut or bolt head. The tool has an annular section with an outside and an inside surface encircling the central axis of the fastener. The outside surface has at least one recess with a striking surface and guide surface. The striking surface lies in a plane intersecting the central axis. With the annular section placed around the fastener, the striking surface intersects a predetermined radial projection from the central axis. The striking surface is struck at a right angle to the predetermined radial projection to turn the nut or bolt head.

11 Claims, 2 Drawing Sheets

IMPACT TOOL AND METHOD

BACKGROUND OF THE INVENTION

1. Field of the Invention

The present invention relates to impact tools and methods, and in particular, to compact devices that fit over a nut, bolt head or other fastener for turning them.

2. Description of Related Art

Threaded fasteners such as nuts and bolts may be tightened and left in place for long periods of time. Loosening such fasteners may be difficult because of various effects such as rusting, debris on threads, deformation of the fastener, chemical corrosion and bonding, etc. in many situations the ability to loosen the fastener may be critical for maintaining an associated machine. For example, an automobile engine has many replaceable parts that periodically wear and must be replaced by loosening bolts and nuts or other fasteners.

Applying torque to a fastener with a wrench having a long lever arm may exacerbate the problem by snapping a threaded shank or by rounding or shearing a bolt head. After such a catastrophic failure a mechanic will probably need to drill out the fastener, a difficult and time-consuming procedure.

Penetrating liquids are sometimes used to help loosen the frozen fastener but a penetrant may be ineffective in some situations, e.g. with deformed fasteners.

In some circumstances the fastener can be loosen by mechanical or thermal shock. For example, the fastener can be heated with a simple torch which causes a differential thermal expansion that can loosen the fastener. Alternatively, hitting the fastener with a hammer may break a bond that prevents loosening. However, a hammer blow will often produce an ineffective axial shock wave without applying a loosening torque.

Known bolt/nut removers employ a socket-like device with internal flutes that can grip a rounded bolt head. A wrench may be applied to this device to remove the bolt. A known impact driver has a body with an internal cam mechanism for driving a distal shaft that is fitted with a socket or other accessory. The driver body may be struck with a hammer, which causes the cam to rotate the shaft and its accessory.

See also U.S. Pat. Nos. 3,366,187; 3,799,011; 3,861,250; 4,708,209; 4,807,349; 4,864,902; 5,904,076; 6,370,993; 6,668,686; 7,044,035; and 7,089,833.

Accordingly, there is a need for an improved impact device that can simply and efficiently turn a fastener.

SUMMARY OF THE INVENTION

In accordance with the illustrative embodiments demonstrating features and advantages of the present invention, there is provided an impact tool adapted to fit around a fastener such as nut or bolt head. The tool has an annular section with an outside and an inside surface encompassing a central axis. The outside surface has at least one recess with a striking surface and guide surface. The striking surface lies in a plane intersecting the central axis.

In accordance with another aspect of the invention, there is provided a method for turning a fastener such as a nut or bolt head about a central axis. The method employs an annulus whose outside surface has at least one recess with a striking surface that is intersected by a predetermined radial projection from the central axis. The method includes the step of placing the annulus around the fastener. Another step is striking the striking surface at a right angle to the predetermined radial projection to turn the fastener.

In accordance with yet another aspect of the invention, there is provided an impact tool adapted to fit around a fastener such as a nut or bolt head. The tool includes an annular section having an outside and an inside surface centered on a central axis. The outside surface has at least three notches, each with a striking surface and convex guide surface. The striking surface lies in a plane intersecting the central axis and intersecting the guide surface perpendicularly. The outside surface between the notches is shaped as a portion of a cylinder centered on the central axis. The inside surface includes a plurality of flats arranged to have a cross-section providing a regular polygonal outline. The striking surface points to a position near the center of at least one of the plurality of flats.

By employing apparatus and methods of the foregoing type, an improved technique is achieved for turning a nut, bolt or other fastener. In a disclosed embodiment an annular device has an inside surface designed to fit around a fastener; e.g. a hex nut or hex bolt head. This device can be relatively compact so that it can be used in tight spaces.

The outside surface of this annular device is cylindrical except for a number of notches, three in a disclosed embodiment. Each notch has a striking surface that lies in a plane intersecting the central axis of the annular device. Thus the striking surface projects radially. This striking surface perpendicularly intersects a convex guide surface. This guide surface extends around the device, eventually reaching the cylindrical portion of the outside surface between the notches. In one embodiment the striking surface and guide surface extend across the full thickness of the device. In another embodiment the striking and guide surfaces do not cover the full thickness of the annular device and form instead a descending groove bordered by parallel sidewalls.

The device may be placed around a nut or bolt head. A flat head punch or the like may be placed square against one of the striking surfaces. The punch will be perpendicular to a plane intersecting the central axis of the annular device and the nut or bolt head. The punch can then be struck with a hammer to apply a torque to the annular device and thus the fastener. The punch acts through a relatively long lever arm since its impact is applied perpendicular to a plane containing the central axis.

The annular device can be placed with either side down to produce either a clockwise or counterclockwise torque upon impacting the striking surface. Thus the same device can be used to either loosen or tighten a fastener.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION OF THE PREFERRED EMBODIMENTS

Figure 1:
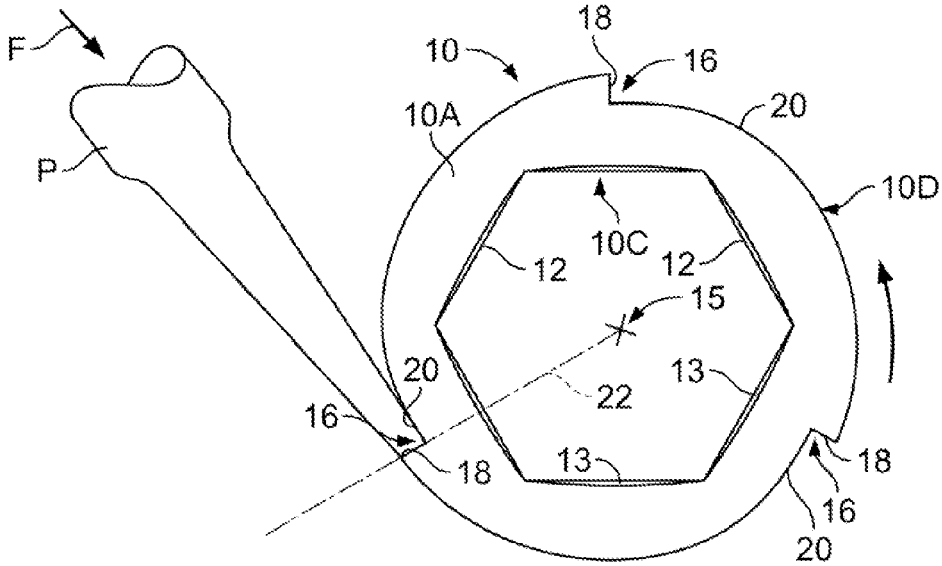
FIG. 1 is a plan view of an impact tool being used with a flat head punch in accordance the principles of present invention.
Figure 2:
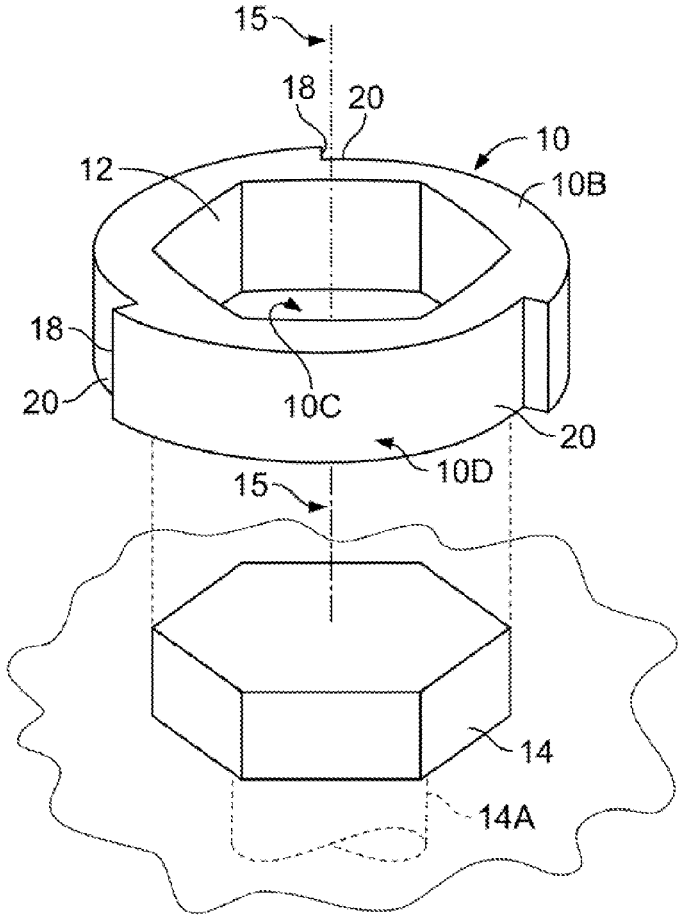
FIG. 2 is a perspective view of the tool of FIG. 1 about to be placed over a bolt head.

Referring to FIGS. 1 and 2, the illustrated impact tool 10 is an annulus (also referred to as an annular section) having a first side 10A and second side 10B. In this embodiment tool 10 is made of steel. The inside surface 10C of tool 10 is shown with six, substantially rectangular flats 12 designed to fit over hex bolt head 14. Flats 12 are parallel to and symmetrically arranged around central axis 15. The corners between flats 12 and the two sides 10A and 10B will be relieved by beveled surfaces 13, which help guide components into the region embraced by the inside surface 10C.

It will be appreciated that in some embodiments inside surface 10C may be redesigned for a bolt or nut that is square or has eight or any other number of sides. In some embodiments inside surface 10C may have a large number of axially oriented grooves much like that found in a box wrench.

Outside surface 10D of tool 10 is substantially cylindrical except that the cylindrical shape is interrupted by three, equiangularly spaced recesses, shown as notches 16. Each of the notches 16 has a planar striking surface 18 that lies along a radial projection from central axis 15. In particular, striking surface 18 lies in a plane 22 that intersects central axis 15. It will be noticed that each of the striking surfaces 18 also point toward (align with) the center of one of the flats 12, although such alignment is optional and in other embodiments the striking surface 18 may point to any other position along the periphery of inside surface 10C.

Notches 16 each have a guide surface 20 that extends about 45° around the periphery of the outside surface 10D, intersecting striking surface 18 at a right angle. Guide surface 20 initially extends at a right angle from surface 18, but this angle gradually increases for positions further along guide surface 24. Eventually, guide surface 20 (which is convex) merges with the cylindrical portions of outside surface 10D between notches 16.

In this embodiment surfaces 18 and 20 extend the full thickness of the device 10 and therefore reach the two sides 10A and 10B. The corners between outside surface 100 (including notches 16) and the opposite sides 10A and 10B may be rounded in some embodiments.

Figure 3:
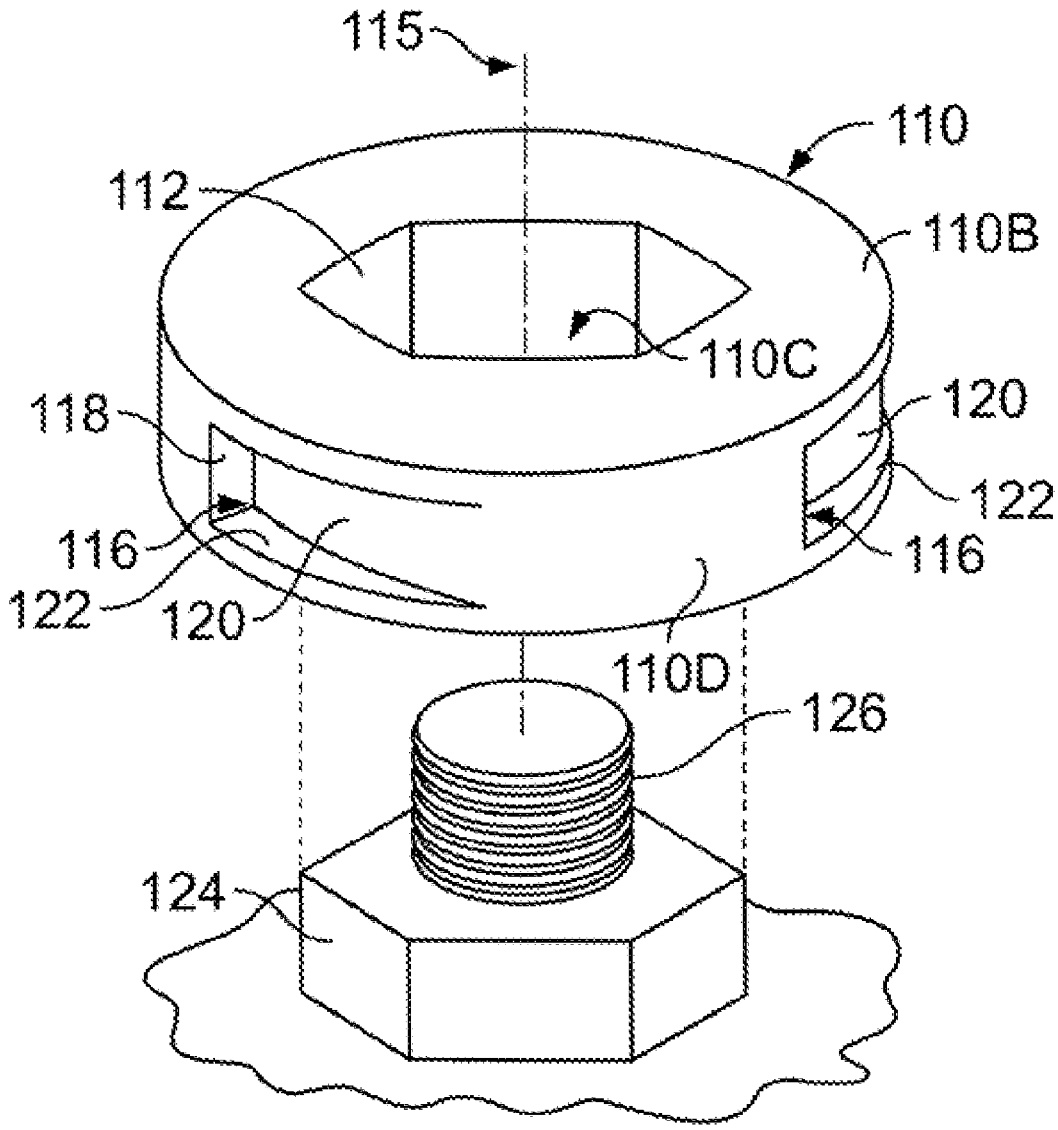
FIG. 3 is a perspective view of an impact tool that is an alternate to that of FIG. 1 and shown about to be placed over a nut.

Referring to the illustrated, alternate impact tool of FIG. 3, its components and features that correspond to that of FIG. 1 have the same reference numerals but raised by 100. In particular, inside surface 110C with its flats 112 is the same as before but outside surface 110D has a substantially different recess 116. Recess 116 has a striking surface 118 lying in a plane intersecting central axis 115 and a convex guide surface 120 extending away about 45° before reaching the normally cylindrical portions of outside surface 110D between the notches. However, recess 116 does not extend across the full thickness of impact tool 110 and is therefore shown as a descending groove bordered by sidewalls 122.

In FIG. 3 impact tool 110 is shown about to be placed around nut 124, which is screwed onto threaded shaft 126.

To facilitate an understanding of the principles associated with the foregoing apparatus, its operation will be briefly described in connection with the apparatus of FIGS. 1 and 2. In those Figures impact tool 10 is shown being installed on bolt head 14 with its striking surfaces 18 facing in a clockwise direction. The impact end of the flathead punch P is shown touching one of the striking surfaces 18.

The longitudinal axis of punch P is held perpendicular to surface 18 and thus to the plane 22 that extends through central axis 15. Guide surface 20 helps guide the punch P and keep it perpendicular to striking surface 18. Being perpendicular, punch P is able to deliver a force F perpendicular to the effective lever (radial projection) extending between central axis 15 and the point of impact on striking surface 18. Consequently, all of the force F is used to create a torque for turning impact tool 10 counterclockwise. If punch P was skewed from this angle, force F would apply a nonproductive force component parallel to radial plane 22 and the resulting component perpendicular to plane 22 would be reduced. Also, if the striking surface 18 was skewed from the illustrated position but with punch P kept in the illustrated orientation, the striking surface would tend to be struck by an edge of the working face of the punch.

With punch P held in the illustrated position, a user will strike the opposite end of the punch with a hammer to produce an impulse tending to rotate tool 10 and bolt head 14 counterclockwise around central axis 15. This impulse produces a brief but rather large torque that creates a twisting shock between threaded bolt shank 14A and its threaded hole. This large shock tends to break the binding forces caused by rusting, debris on the threads, chemical corrosion, chemical bonding, deformation of the threaded shank 14A or of its threaded hole, etc.

Punch P will be struck repeatedly until the user notices that device 10 and bolt head 14 have begun to turn. Once bolt 14 has been loosened in this manner, it can be removed using a wrench or other conventional tools.

While the foregoing showed loosening of a bolt, impact tool 10 can be used to tighten as well. To be used as a tightening device, tool 10 is simply flipped so that the striking surfaces 18 face in a counterclockwise direction. Consequently, if device 10 is placed over bolt head 14 after it has been already tightened by ordinary means, the bolt can be tightened even further. As before, a flathead punch P will be placed against the striking surface 18 and struck one or more times to tighten the bolt 14 by turning it clockwise.

The operation of the tool of FIG. 3 will be similar except that the punch can be placed inside recess 116 to engage striking surface 118 perpendicularly.

It is appreciated that various modifications may be implemented with respect to the above described embodiments. The size of the impact tool can be varied depending upon the size of the fastener to be turned and the amount of space available. In some cases the impact tool will be sold as a set to accommodate various sizes and types of fasteners. The radial thickness of the tool can be chosen to achieve the desired strength and reliability. In addition, increasing the radial dimension of the tool can increase the amount of torque delivered by the tool. Embodiments of the tool having a substantial radial thickness may employ a recess in the form of a bore or tunnel ending in a striking surface. While an annulus is disclosed, some embodiments may be cup shaped and therefore only have a section that is annular. While the outside surface of the tool is in part cylindrical, other embodiments may have an outside service that is toroidal, in part. The foregoing described using a flathead punch, but other types of punches can be used, as well as simple rods that are not designed as punches.

Obviously, many modifications and variations of the present invention are possible in light of the above teachings. It is therefore to be understood that within the scope of the appended claims, the invention may be practiced otherwise than as specifically described.

The invention claimed is:

1. An impact tool adapted to fit around a fastener such as a nut or bolt head, comprising:

an annular section having an outside and an inside surface encompassing a central axis, said inside surface including a plurality of flats adapted to grip said fastener, said outside surface having a plurality of recesses each with a striking surface and a convex descending guide surface, said convex descending guide surface comprising a convex descending groove located between an opposing pair of parallel sidewalls, said groove descending until reaching said striking surface, said striking surface being planar and lying in a plane intersecting said central axis.

2. An impact tool according to claim 1 wherein said plurality of recesses each comprise a notch.

3. An impact tool according to claim 1 wherein guide surface has at said striking surface a tangent that intersects said striking surface perpendicularly.

4. An impact tool according to claim 2 wherein said plurality of recesses each comprise a notch.

5. An impact tool according to claim 1 wherein said inside surface is centered on said central axis.

6. An impact tool according to claim 1 wherein said outside surface between said recesses is shaped as a portion of a cylinder centered on said central axis.

7. An impact tool according to claim 5 wherein each of said recesses comprises a notch, said guide surface having at said striking surface a tangent that intersects said striking surface perpendicular.

8. An impact tool according to claim 1 wherein said plurality of recesses is at least three in number.

9. An impact tool according to claim 1 wherein said inside surface has a hexagonal cross-section.

10. An impact tool according to claim 1 wherein said plurality of flats are arranged to have a cross-section with a regular polygonal outline, said striking surface pointing to a position near the center of at least one of said plurality of flats.

11. An impact tool adapted to fit around a fastener such as a nut or bolt head, comprising:

an annular section having an outside and an inside surface centered on a central axis, said outside surface having at least three notches each with a striking surface and convex descending guide surface, said convex descending guide surface comprising a convex descending groove located between an opposing pair of parallel sidewalls, said groove descending until reaching said striking surface, said striking surface being planar and lying in a plane intersecting said central axis, said guide surface having at said striking surface a tangent that intersects said striking surface perpendicularly, said outside surface between said notches being shaped as a portion of a cylinder centered on said central axis, said inside surface including a plurality of flats adapted to grip said fastener and arranged to have a cross-section providing a regular polygonal outline, said striking surface pointing to a position near the center of at least one of said plurality of flats.

* * * * *